US011631531B2

(12) United States Patent
Park

(10) Patent No.: US 11,631,531 B2
(45) Date of Patent: Apr. 18, 2023

(54) COIL COMPONENT

(71) Applicant: SAMSUNG ELECTRO-MECHANICS CO., LTD., Suwon-si (KR)

(72) Inventor: Jong Ik Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 725 days.

(21) Appl. No.: 16/566,255

(22) Filed: Sep. 10, 2019

(65) Prior Publication Data

US 2020/0312536 A1 Oct. 1, 2020

(30) Foreign Application Priority Data

Apr. 1, 2019 (KR) ..... 10-2019-0037735

(51) Int. Cl.
*H01F 27/32* (2006.01)
*H01F 27/34* (2006.01)
*H01F 27/29* (2006.01)

(52) U.S. Cl.
CPC ..... *H01F 27/34* (2013.01); *H01F 27/29* (2013.01); *H01F 27/327* (2013.01)

(58) Field of Classification Search
CPC ..... H01F 27/34; H01F 27/29; H01F 27/327
USPC ..... 336/192
See application file for complete search history.

(56) References Cited

U.S. PATENT DOCUMENTS 4,484,161 A * 11/1984 Barger ..... H01F 7/20 333/219.1
6,292,139 B1 * 9/2001 Yamamoto ..... H01Q 1/38 430/315
6,452,473 B1 * 9/2002 Suzuki ..... H01F 17/0013 336/200
9,251,943 B2 * 2/2016 Jeong ..... H01F 17/0013
10,854,383 B2 * 12/2020 Choi ..... H01F 27/255
2016/0268038 A1 9/2016 Choi
2017/0162317 A1 * 6/2017 Taniguchi ..... H01F 27/292
(Continued)

FOREIGN PATENT DOCUMENTS

CN 109545503 A 3/2019
JP 2014082280 A * 5/2014
(Continued)

OTHER PUBLICATIONS

Korean Office Action dated Mar. 1, 2023, issued in corresponding Korean Patent Application No. 1 0-2019-0037735 with English translation.

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

A coil component is provided. The coil component includes a body having one surface and the other surface, opposing each other, and including a plurality of wall surfaces respectively connecting the one surface and the other surface, a coil portion embedded in the body, first and second external electrodes spaced apart from each other on one surface of the body, and respectively connected to the coil portion, a groove formed continuously along an edge of the other surface of the body, and a stress relieving portion disposed on the other surface of the body to fill at least a portion of the groove.

18 Claims, 8 Drawing Sheets

(56) References Cited

U.S. PATENT DOCUMENTS

| | | | | |
|---|---|---|---|---|
| 2018/0047498 | A1* | 2/2018 | Nakashima | H01F 17/0013 |
| 2019/0096568 | A1 | 3/2019 | Yoon et al. | |
| 2019/0221511 | A1* | 7/2019 | Yonemori | H05K 3/46 |
| 2019/0362887 | A1* | 11/2019 | Yang | H01F 27/292 |

FOREIGN PATENT DOCUMENTS

| | | | | |
|---|---|---|---|---|
| JP | 5621573 | B2 * | 11/2014 | |
| JP | 6551628 | B2 * | 7/2019 | H01F 17/00 |
| KR | 10-2013-0062729 | A | 6/2013 | |
| KR | 10-2016-0108935 | A | 9/2016 | |
| KR | 10-2017-0085881 | A | 7/2017 | |
| KR | 10-2018-0025323 | A | 3/2018 | |
| WO | WO-2012144103 | A1 * | 10/2012 | H01F 17/0013 |

* cited by examiner

COIL COMPONENT

CROSS-REFERENCE TO RELATED APPLICATION(S)

This application claims the benefit of priority to Korean Patent Application No. 10-2019-0037735 filed on Apr. 1, 2019 in the Korean Intellectual Property Office, the entire disclosure of which is incorporated herein by reference.

TECHNICAL FIELD

The present disclosure relates to a coil component.

BACKGROUND

Inductors, coil components, are representative passive electronic components used in electronic devices along with resistors and capacitors.

Normally, coil components are formed collectively through a large-scale process for efficient mass production, and are separated into a plurality of units at the end of the process. In detail, a large-sized coil substrate in which unit bodies corresponding to bodies of coil components are connected to each other is formed, and the coil substrates are diced to separate a plurality of unit bodies, such that respective coil components are completed by forming external electrodes on respective unit bodies.

In such a dicing process, cracks may occur in the unit body, and further, a portion of the unit body may fall off.

SUMMARY

An aspect of the present disclosure is to provide a coil component in which defects during dicing may be reduced.

An aspect of the present disclosure is to provide a coil component capable of preventing bleeding during plating in forming external electrodes.

According to an aspect of the present disclosure, a coil component includes a body having one surface and another surface opposing each other, and including a plurality of wall surfaces respectively connecting the one surface and the another surface, a coil portion embedded in the body, first and second external electrodes spaced apart from each other, and respectively connected to the coil portion, a groove disposed continuously along an edge of the another surface of the body, and a stress relieving portion disposed on the another surface of the body and covering at least a portion of the groove.

According to another aspect of the present disclosure, a coil component includes a body having one surface and another surface opposing each other, and including a plurality of wall surfaces respectively connecting the one surface and the another surface; a coil portion embedded in the body; first and second external electrodes spaced apart from each other, and respectively connected to the coil portion; and a stress relieving portion disposed on the another surface of the body, wherein the body has a groove continuously disposed in an edge of the another surface of the body, whereby a dimension of the plurality of wall surfaces of the body in a thickness direction is smaller than a distance between the one surface and the another surface of the body, and the stress relieving portion covers at least a portion of the groove, and has a side surface disposed on substantially the same plane as at least one of the plurality of wall surfaces of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
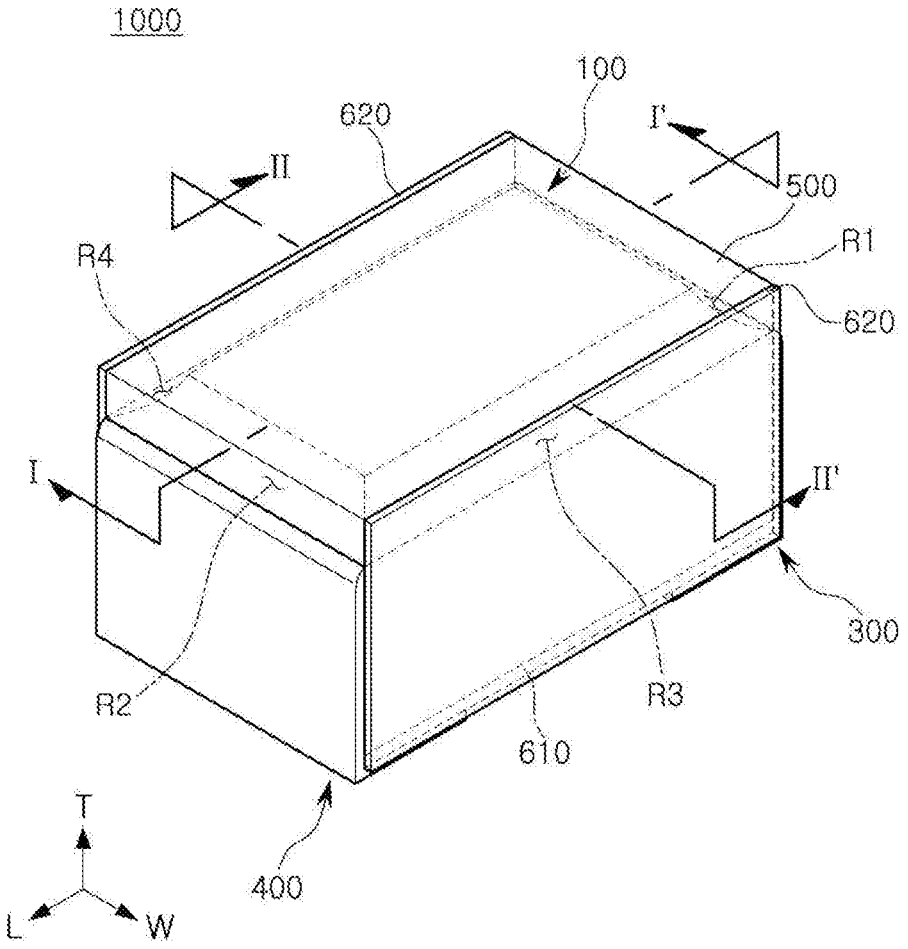
FIG. 1 is a perspective view schematically illustrating a coil component according to an exemplary embodiment in the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to" another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

In addition, the term "coupled" is used not only in the case of direct physical contact between the respective constituent elements in the contact relation between the constituent elements, but also in the case in which other constituent elements are interposed between the constituent elements such that they are in respective contact with each other, being used as a comprehensive concept.

The drawings may not be to scale, and the relative size, proportions, and depiction of elements in the drawings may be exaggerated for clarity, illustration, and convenience.

In the drawing, the L direction may be defined as a first direction or a length direction, the W direction as a second direction or a width direction, and the T direction as a third direction or a thickness direction.

Hereinafter, a coil component according to an embodiment in the present disclosure will be described in detail with reference to the accompanying drawings.

Referring to the accompanying drawings, the same or corresponding components are denoted by the same reference numerals, and redundant descriptions thereof will be omitted.

Various types of electronic components are used in electronic devices. Various types of coil components may be suitably used for noise removal or the like between these electronic components.

For example, as a coil component in an electronic device, a power inductor, a high frequency inductor (HF Inductor), a general bead, a bead for high frequency (GHz Bead), a common mode filter, or the like may be used.

Figure 2:
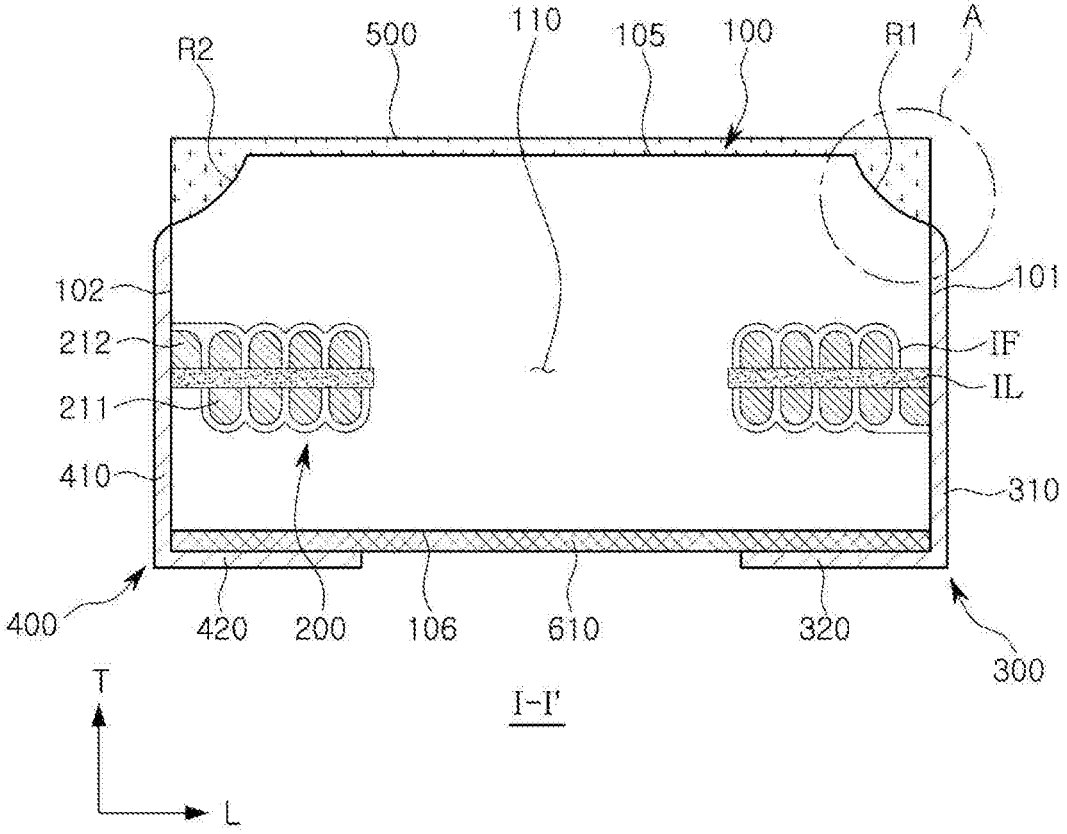
FIG. 2 is a cross-sectional view taken along line I-I' in FIG. 1.
Figure 3:
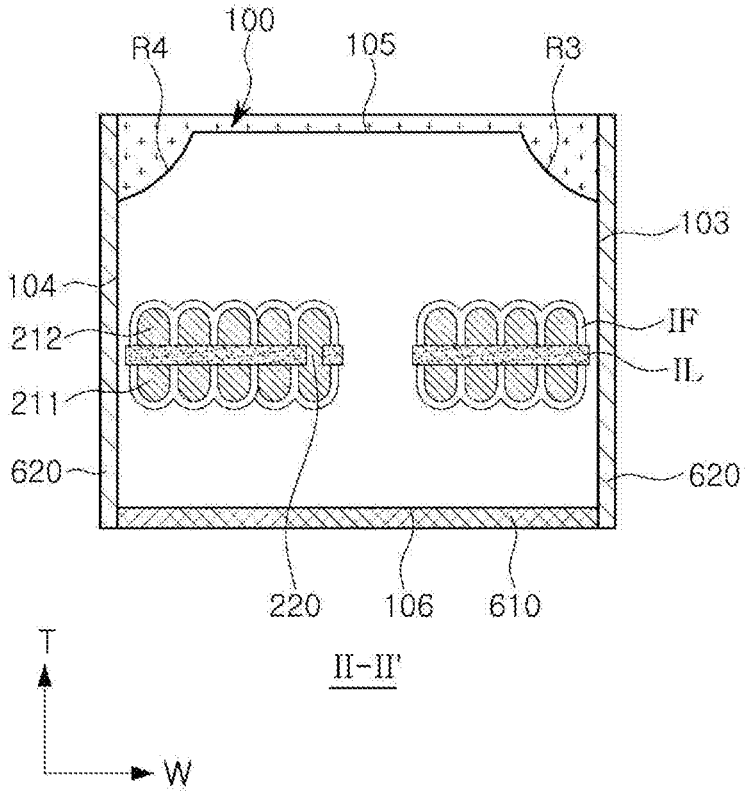
FIG. 3 is a cross-sectional view taken along line II-II' in FIG. 1.
Figure 4:
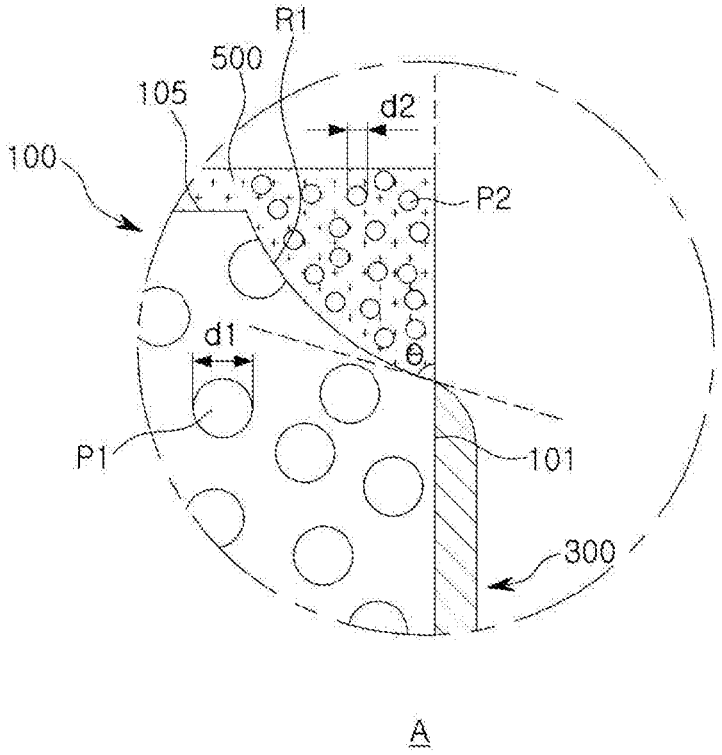
FIG. 4 is an enlarged view of region A in FIG. 1.

FIG. 1 is a perspective view schematically illustrating a coil component according to an exemplary embodiment of the present disclosure. FIG. 2 is a cross-sectional view taken along line I-I' in FIG. 1. FIG. 3 is a cross-sectional view taken along line II-II' in FIG. 1. FIG. 4 is an enlarged view of area A in FIG. 1. FIGS. 5 to 8 are views sequentially illustrating a portion of a method of manufacturing a coil component according to an exemplary embodiment of the present disclosure.

Referring to FIGS. 1 to 4, a coil component 1000 according to an exemplary embodiment of the present disclosure includes a body 100, a coil portion 200, external electrodes 300 and 400, grooves R1, R2, R3 and R4, a stress relieving portion 500 and a first insulating layer 610, and may further include an internal insulating layer IL, second insulating layers 620 and 630 and an insulating film IF.

The body 100 forms the appearance of the coil component 1000 according to the embodiment.

The body 100 may be formed to have a hexahedral shape as a whole.

Hereinafter, according to an exemplary embodiment of the present disclosure the body 100 may have a hexahedral shape by way of example. However, these descriptions do not exclude coil components that include bodies formed to have shapes other than hexahedral, within the scope of the present disclosure.

Referring to FIGS. 2 and 3, the body 100 has a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. Each of the first to fourth surfaces 101, 102, 103 and 104 of the body 100 corresponds to a wall surface of the body 100, connecting the fifth surface 105 and the sixth surface 106 of the body 100 to each other. In the following description, both ends of the body 100 among a plurality of wall surfaces thereof refer to the first surface 101 and the second surface 102 of the body 100, and both opposing side surfaces of the body 100 among the plurality of wall surfaces thereof may refer to the third surface 103 and the fourth surface 104 of the body 100.

The body 100 may be formed in such a manner that a coil component 1000 according to the exemplary embodiment of the present disclosure in which external electrodes 300 and 400 to be described later, a stress relieving portion 500 and a first insulating layer 610 are formed, has a length of 2.0 mm, a width of 1.2 mm, and a thickness of 0.65 mm, by way of example, but an embodiment thereof is not limited thereto. On the other hand, since the above-described numerical values are values not taking process errors into account, numerical values different from the above-mentioned numerical values, due to process errors, may also be within the scope of the present disclosure.

The body 100 may include a magnetic material and a resin. In detail, the body 100 may be formed by laminating one or more magnetic composite sheets including a resin and a magnetic material dispersed in the resin. In addition, the body 100 may have a structure in addition to the structure in which the magnetic material is dispersed in the resin. For example, the body 100 may be formed of a magnetic material such as ferrite.

A magnetic material P1 may be ferrite or magnetic metallic powder.

Ferrite powder may be one or more of spinel type ferrite such as Mg—Zn type, Mn—Zn type, Mn—Mg type, Cu—Zn type, Mg—Mn—Sr type, Ni—Zn type or the like, hexagonal ferrite such as Ba—Zn, Ba—Mg, Ba—Ni, Ba—Co, Ba—Ni—Co type, or the like, garnet type ferrite such as Y type or the like, and Li-based ferrite.

The magnetic metallic powder may include one or more selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metallic powder may be at least one or more selected from the group consisting of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder, and Fe—Cr—Al alloy powder. Hereinafter, an example in which the magnetic material P1 is a magnetic metallic powder will be described.

The magnetic metallic powder P1 may be amorphous or crystalline. For example, the magnetic metallic powder P1 may be an Fe—Si—B—Cr amorphous alloy powder, but is not limited thereto.

The magnetic metallic powder P1 may have an average diameter of about 0.1 mu m to 30 mu m, but is not limited thereto.

The body 100 may include two or more kinds of magnetic materials dispersed in a resin. In this case, the term "different kinds of magnetic materials" means that the magnetic materials dispersed in the resin are distinguishable from each other by at least one of an average diameter, a composition, crystallinity and a shape.

The resin may include, but is not limited to, epoxy, a polyimide, a liquid crystal polymer, or the like, alone or in combination.

The body 100 includes the coil portion 200 and a core 110 passing through an internal insulating layer IL, to be described later. The core 110 may be formed by filling a through hole of the coil portion 200 with a magnetic composite sheet, but an embodiment thereof is not limited thereto.

The grooves R1, R2, R3 and R4 are formed on corners between the first to fourth surfaces 101, 102, 103 and 104 of the body 100 and the fifth surface 105 of the body 100, respectively, to be connected to one another. For example, the grooves R1, R2, R3 and R4 are continuously formed along an edge of the fifth surface 105 of the body 100. The grooves R1, R2, R3 and R4 do not extend to the sixth surface 106 of the body 100 to be prevented from penetrating through the body 100 in the thickness direction T of the body 100. A distance between upper and lower portions of each of the first to fourth surfaces 101, 102, 103 and 104 of the body 100 in the thickness direction T is reduced due to the grooves R1, R2, R3 and R4, thereby reducing the thickness of the body 100 to be penetrated by a dicing blade in the dicing process and resulting in reducing defects that may occur in the dicing process.

Depths of the grooves R1, R2, R3 and R4 may be 50 μm or more and 60 μm or less. If the depth of the grooves R1, R2, R3 and R4 is less than 50 μm, the magnetic metallic powder P1 of the body 100 may be dropped during dicing or cracks may occur in a direction from the surface of the body 100 to the inside of the body 100. In this case, in forming the external electrodes 300 and 400 by plating, a plating liquid may penetrate into the body 100. If the depth of the grooves R1, R2, R3 and R4 is greater than 60 μm, the loss of a magnetic substance of the body 100 increases due to the volume increase of the grooves R1, R2, R3 and R4, such that component characteristics such as inductance (L) and a Q value may be deteriorated. In this case, the depths of the grooves R1, R2, R3 and R4 may refer to distances, from an intersection at which a virtual extension line of the fifth surface 105 of the body 100 and virtual lines extending from the first to fourth surfaces 101, 102, 103 and 104 of the body 100 are perpendicular to each other, to lower surfaces of the grooves R1, R2, R3 and R4.

The grooves R1, R2, R3 and R4 increase the surface area of the body 100. As a result, a contact area between the body 100 and the stress relieving portion 500 to be described later increases, and coupling force between the body 100 and the stress relieving portion 500 may be improved.

The stress relieving portion 500 is disposed on the fifth surface 105 of the body 100 to fill at least a portion of the grooves R1, R2, R3 and R4. The stress relieving portion 500 may be integrally formed with internal surfaces of the grooves R1, R2, R3 and R4 and the fifth surface 105 of the body 100, by disposing a material for a stress relieving portion on the fifth surface 105 of the body 100 in which the grooves R1, R2, R3 and R4 are formed. In this case, the stress relieving portion 500 may be formed to have a form filling the entirety of the grooves R1, R2, R3 and R4, but an embodiment thereof is not limited thereto. For example, the stress relieving portion 500 may also be conformally formed along the internal surfaces of the grooves R1, R2, R3 and R4 and the fifth surface 105 of the body 100. In this case, to reduce stress in the dicing process, the stress relieving portion 500 may be configured in such a manner that a thickness of a region thereof disposed on the internal surfaces of the grooves R1, R2, R3 and R4 is greater than a thickness of a region thereof disposed on the fifth surface 105 of the body 100.

A side surface of the stress relieving portion 500 and at least one of the first to fourth surfaces 101, 102, 103 and 104 of the body 100 may be disposed on substantially the same plane, which will be described later.

The stress relieving portion 500 may be formed of a thermoplastic resin such as a polystyrene type, a vinyl acetate type, a polyester type, a polyethylene type, a polypropylene type, a polyamide type, a rubber type, an acrylic type or the like, a thermosetting resin such as a phenol type, an epoxy type, a urethane type, a melamine type, an alkyd type or the like, a photoimageable resin, or an insulating resin such as parylene.

The stress relieving portion 500 may further include a filler P2 dispersed in the above-described insulating resin. The filler P2 may be an inorganic filler, or an organic filler, a powder phase of the above-described insulating resin. The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$). The filler P2 is dispersedly disposed in the stress relieving portion 500 and functions as an anchor. For example, the filler P2 may prevent the stress relieving portion 500 from being delaminated from the surface of the body 100 and the internal surfaces of the grooves R1, R2, R3 and R4 during dicing. A particle diameter d2 of the filler P2 may be smaller than a particle diameter d1 of the magnetic metallic powder P1 of the body 100. As a result, the filler P2 is disposed in a relatively large amount in the grooves R1, R2, R3 and R4, to efficiently disperse stress applied to the magnetic metallic powder P1 exposed on the internal surfaces of the grooves R1, R2, R3 and R4 during dicing. For example, the filler P2 may prevent the magnetic metallic powder P1 from separating from the internal surfaces of the grooves R1, R2, R3 and R4 during dicing.

An angle formed by a side surface of the stress relieving portion 500 and one surface of the stress relieving portion 500, contacting the grooves R1, R2, R3 or R4, may be less than 90 degrees, with respect to a cross section of the body 100 in the thickness direction of the body 100. Thus, the angle at which the dicing blade contacts the body 100 may be reduced, such that stress applied to the body 100 at the time of dicing may be reduced.

The grooves R1, R2, R3 and R4 and the stress relieving portion 500 will be described in more detail with reference to FIGS. 5A, 6A, 7A and 8A.

Figure 5A:
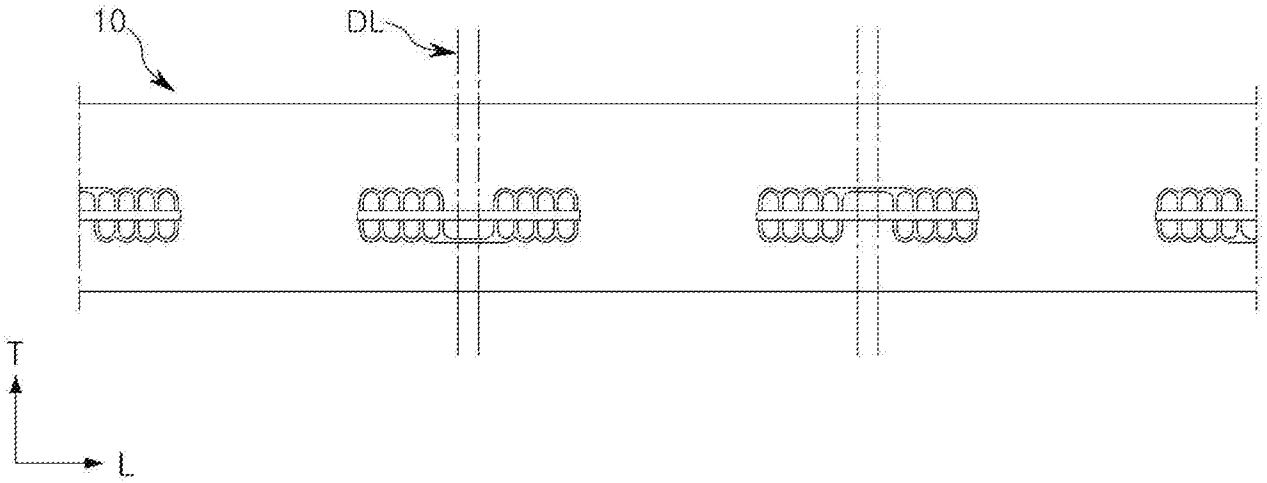
FIGS. 5A, 5B, 6A, 6B, 7A, 7B, 8A, and 8B are views sequentially illustrating a portion of a method of manufacturing a coil component according to an exemplary embodiment in the present disclosure.
Figure 5B:
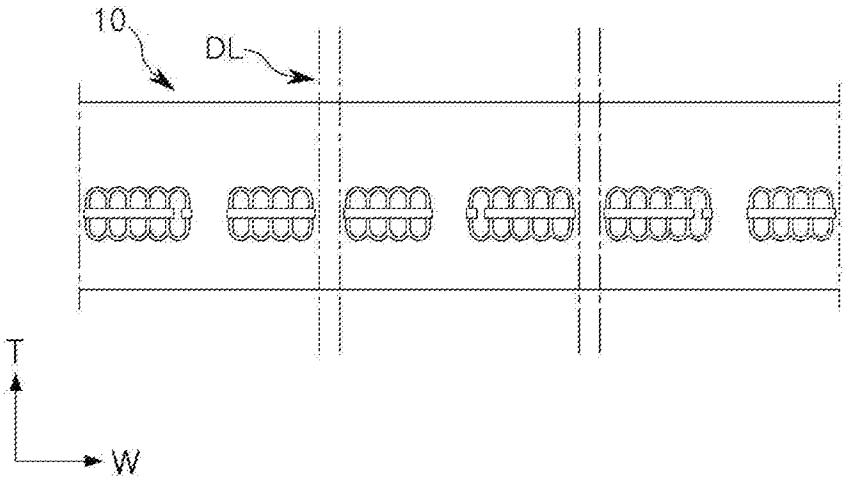

Referring to FIGS. 5A and 5B, a coil substrate 10 is formed. The coil substrate 10 refers to a state in which a plurality of bodies 100 are connected to each other in the length direction L and the width direction W. In detail, the coil substrate 10 may be formed by forming a plurality of coil portions on a large-area substrate, trimming the large-area substrate, and then laminating and curing a magnetic composite sheet on both surfaces of the large-area substrate.

Figure 6A:
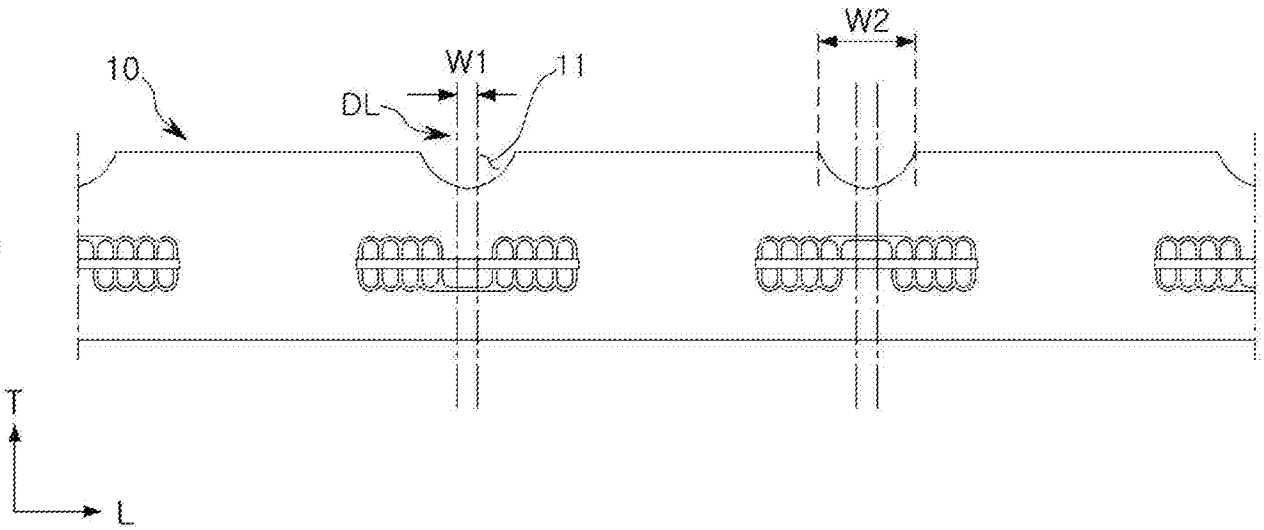
Figure 6B:
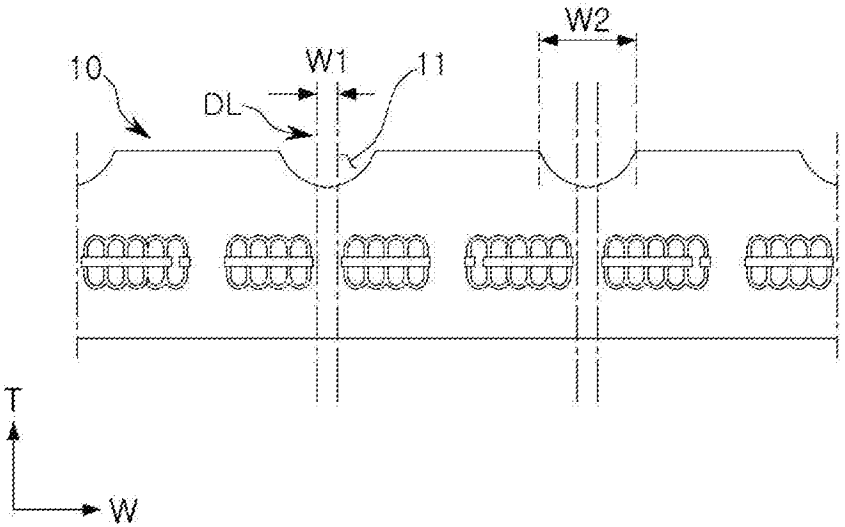

Subsequently, referring to FIGS. 6A and 6B, pre-dicing is performed along a dicing line DL on an upper surface of the coil substrate 10, thereby forming a pre-dicing groove 11. This pre-dicing is performed on the entirety of dicing lines DL in the length direction L and the width direction W of the coil substrate 10. A width W1 of a pre-dicing tip is wider than a width of the dicing line of the coil substrate 10 (or a width W2 of the dicing blade). The pre-dicing grooves 11 are the grooves R1, R2, R3 and R4 of each body 100 and are formed in the coil substrate 10 to have a form corresponding to the shape of the pre-dicing tip. A pre-dicing depth corresponds to the depth of the groove R1, R2, R3 or R4 described above.

Figure 7A:
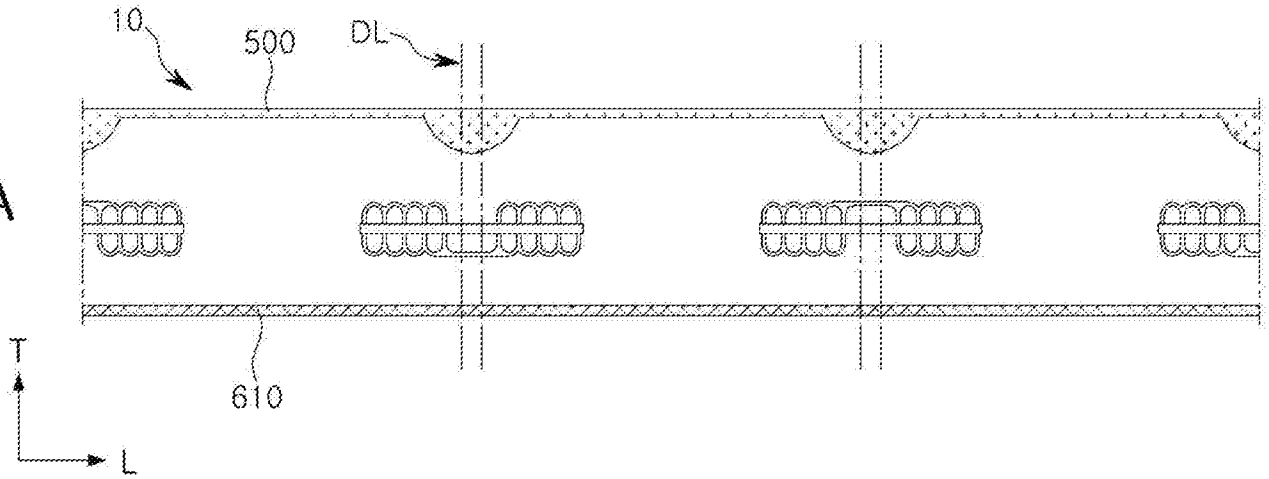
Figure 7B:
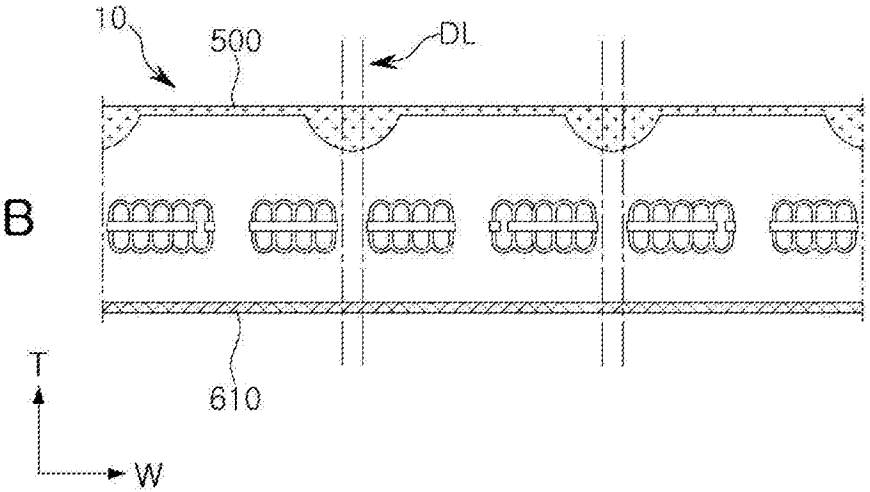

Referring to FIGS. 7A and 7B, then, the stress relieving portion 500 and a first insulating layer 610 to be described later are disposed on upper and lower surfaces of the coil substrate 10, respectively. The stress relieving portion 500 and the first insulating layer 610 may be formed of an insulating film including an insulating resin or the like, or may be formed of an insulating paste including an insulating resin.

Figure 8A:
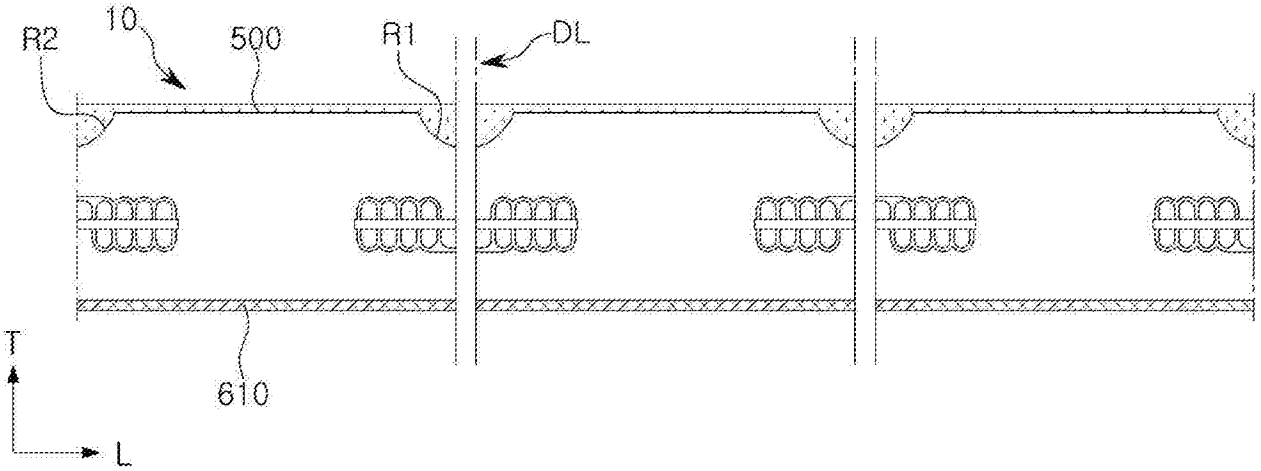
Figure 8B:
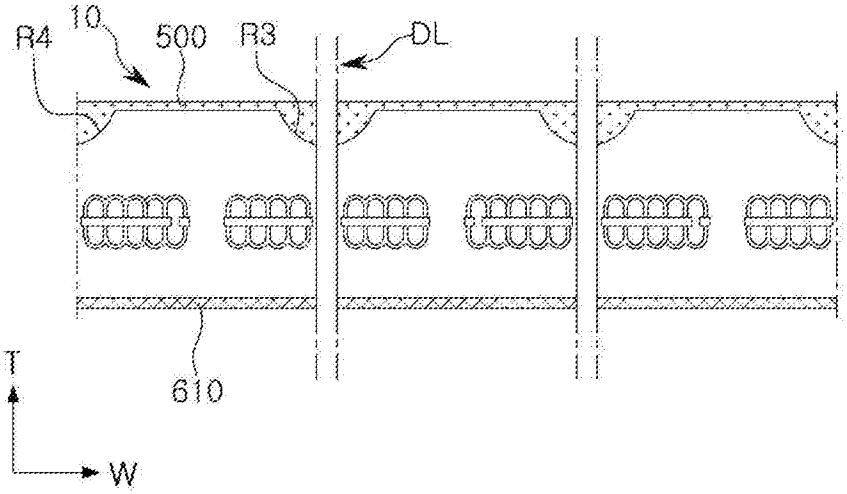

Referring to FIGS. 8A and 8B, dicing is performed along the dicing line DL to individualize the plurality of bodies 100. In this case, since the pre-dicing groove 11 is formed in the coil substrate 10, the dicing depth is reduced as compared with the case in which the pre-dicing groove 11 is not formed. Therefore, dropping and cracking of the magnetic metallic powder P1 occurring during dicing may be reduced.

As a result of the above-described process, the side surface of the stress relieving portion 500 and at least one of the first to fourth surfaces 101, 102, 103 and 104 of the body 100 may be disposed on substantially the same plane.

On the other hand, although not illustrated in the drawings, a method of manufacturing a coil component according to an exemplary embodiment of the present disclosure may further include, forming second insulating layers 620 and 630 to be described later on the first to fourth surfaces 101, 102, 103 and 104 of the body 100, cutting surfaces, after the process of FIGS. 8A and 8B, and forming external electrodes.

The coil portion 200 is embedded in the body 100 to exhibit characteristics of a coil component. For example, when the coil component 1000 according to the exemplary embodiment of the present disclosure is used as a power inductor, the coil portion 200 may function to stabilize the power supply of an electronic device by storing an electric field as a magnetic field and maintaining an output voltage.

The coil portion 200 includes a first coil pattern 211, a second coil pattern 212, and a via 220.

The first coil pattern 211, the internal insulating layer IL and the second coil pattern 212 to be described later may be sequentially laminated in a thickness direction T of the body 100.

Each of the first coil pattern 211 and the second coil pattern 212 may be formed to have a flat spiral shape. As an example, the first coil pattern 211 may include at least one turn about the core 110 of the body 100 on one surface of the internal insulating layer IL (a lower surface of IL in FIG. 2). The second coil pattern 212 may include at least one turn about the core 110 of the body 100 on the other surface of the internal insulating layer IL (an upper surface of IL in FIG. 2). The first and second coil patterns 211 and 212 may be wound in the same direction.

The via 220 penetrates through the internal insulating layer IL to electrically connect the first coil pattern 211 and the second coil pattern 212 to each other, to respectively be in contact with the first coil pattern 211 and the second coil pattern 212. As a result, the coil portion 200 according to the exemplary embodiment of the present disclosure may be formed as a single coil that generates a magnetic field in the thickness direction T of the body 100 in the body 100.

At least one of the first coil pattern 211, the second coil pattern 212, and the via 220 may include at least one conductive layer.

As an example, in the case in which the second coil pattern 212 and the via 220 are formed by a plating method, the second coil pattern 212 and the via 220 may each include a seed layer and an electroplating layer. The seed layer may be formed by an electroless plating method or a vapor deposition method such as sputtering or the like. The electroplating layer may have a single-layer structure or a multi-layer structure. The electroplating layer of the multi-layer structure may be formed to have a conformal film structure in which one electroplating layer is covered by another electroplating layer, and may also be formed to have a form in which only on one surface of one electroplating layer, another electroplating layer is laminated. A seed layer of the second coil pattern 212 and a seed layer of the via 220 may be integrally formed without forming a boundary therebetween, but an embodiment thereof is not limited thereto. The electroplated layer of the second coil pattern 212 and the electroplated layer of the via 220 may be integrally formed without forming a boundary therebetween, but an embodiment thereof is not limited thereto.

As another example, in a case in which the first coil pattern 211 and the second coil pattern 212 are separately formed and then laminated together on the internal insulating layer IL to form the coil portion 200, the via 220 may include a high melting point metal layer and a low melting point metal layer having a melting point lower than that of the high melting point metal layer. In this case, the low melting point metal layer may be formed of a solder containing lead (Pb) and/or tin (Sn). The low melting point metal layer is at least partially melted due to pressure and temperature at the time of lamination, in such a manner that an intermetallic compound layer (IMC layer) may be formed in at least one of gaps between the low melting point metal layer and the first coil pattern 211, between the low melting point metal layer and the second coil pattern 212, and the high melting point metal layer and the low melting point metal layer.

In an example referring to FIG. 2, the first coil pattern 211 and the second coil pattern 212 may protrude from a lower surface and an upper surface of the internal insulating layer IL, respectively. In another example with reference to FIG. 2, the first coil pattern 211 may be embedded in the lower surface of the internal insulating layer IL in such a manner that a lower surface thereof is exposed to the lower surface of the internal insulating layer IL, and the second coil pattern 212 may be exposed to an upper surface of the internal insulating layer IL. In this case, a concave portion is formed in the lower surface of the first coil pattern 211, such that the lower surface of the internal insulating layer IL and the lower surface of the first coil pattern 211 may not be located on the same plane. As another examples with reference to FIG. 2, the first coil pattern 211 may be embedded in the lower surface of the internal insulating layer IL in such a manner that the lower surface thereof is exposed to the lower surface of the internal insulating layer IL, and the second coil pattern 212 may be embedded in the upper surface of the internal insulating layer IL in such a manner that an upper surface thereof may be exposed to the upper surface of the internal insulating layer IL.

Ends of the first coil pattern 211 and the second coil pattern 212 may be exposed to the first and second surfaces 101 and 102 of the body 100, respectively. An end of the first coil pattern 211 exposed to the first surface 101 of the body 100 contacts a first external electrode 300 to be described later, to be electrically connected to the first external electrode 300. An end of the second coil pattern 212 exposed to the second surface 102 of the body 100 contacts a second external electrode 400 to be described later, to be electrically connected to the second external electrode 400.

The first coil pattern 211, the second coil pattern 212 and the via 220 may respectively be formed of a conductive material, such as copper (Cu), aluminum (Al), silver (Ag), tin (Sn), gold (Au), nickel (Ni), lead (Pb), titanium (Ti), alloys thereof, or the like, but a material thereof is not limited thereto.

The internal insulating layer IL may be formed of an insulating material including a thermosetting insulating resin such as an epoxy resin, a thermoplastic insulating resin such as polyimide, or a photoimageable dielectric resin, or an insulating material in which a reinforcing material such as glass fiber or inorganic filler is impregnated with these insulating resins. For example, the internal insulating layer IL may be formed of an insulating material such as a prepreg, an Ajinomoto Build-up Film (ABF), an FR-4, a Bismaleimide Triazine (BT) resin, or photoimageable dielectric (PID), but an embodiment thereof is not limited thereto.

The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

In the case in which the internal insulating layer IL is formed of an insulating material including a reinforcing material, the internal insulating layer IL may provide relatively better rigidity. In the case in which the internal insulating layer IL is formed of an insulating material not containing a glass fiber, the internal insulating layer IL may be advantageous in terms of thinning an overall thickness of the coil component 1000 according to the exemplary embodiment of the present disclosure. In the case in which the internal insulating layer IL is formed of an insulating material containing a photoimageable dielectric resin, the number of processes is reduced, which may be advantageous in terms of reducing the production cost and fine hole processing.

The first insulating layer 610 may be disposed on the sixth surface 106 of the body 100. The first insulating layer 610 may be formed by laminating an insulating film including an insulating resin on the sixth surface 106 of the body 100 or by applying an insulating paste to the sixth surface 106 of the body 100.

The first and second external electrodes 300 and 400 are spaced apart from each other on the sixth surface 106 of the body 100, and are respectively connected to the coil portion 200. The first external electrode 300 includes a first connection portion 310 disposed on the first surface 101 of the body 100 and connected to an end of the first coil pattern 211, and a first extension 320 extending from the first connection portion 310 onto the sixth surface 106 of the body 100. The second external electrode 400 includes a second connection portion 410 disposed on the second surface 102 of the body 100 and connected to an end of the second coil pattern 212, and a second extension 420 extending from the second connection portion 410 onto the sixth surface 106 of the body 100. The first extension 310 and the second extension 410 are disposed on the sixth surface 106 of the body 100, to be spaced apart from each other, such that the first external electrode 300 and the second external electrode 400 may be prevented from being in contact with each other. Since the first insulating layer 610 is disposed on the sixth surface 106 of the body 100 in the embodiment, the first and second extensions 320 and 420 of the first and second external electrodes 300 and 400 extend on the first insulating layer 610 to be spaced apart from each other thereon.

The first and second external electrodes 300 and 400 electrically connect the coil component 1000 to a printed circuit board or the like when the coil component 1000 according to an exemplary embodiment of the present disclosure is mounted on the printed circuit board or the like. For example, the coil component 1000 according to the exemplary embodiment of the present disclosure may be mounted after the sixth surface 106 of the body 100 is disposed to face a printed circuit board. In this case, due to the first and second extension portions 320 and 420 of the first and second external electrodes 300 and 400 together disposed on the sixth surface 106 of the body 100, mounting of the coil component 1000 according to the exemplary embodiment of the present disclosure on the printed circuit board or the like may be facilitated.

The external electrodes 300 and 400 may include at least one of a conductive resin layer and an electroplating layer. The conductive resin layer may be formed by paste printing or the like, and may include one or more conductive metals selected from the group consisting of copper (Cu), nickel (Ni), and silver (Ag), and a thermosetting resin. The electroplating layer may include one or more selected from the group consisting of nickel (Ni), copper (Cu), and tin (Sn).

The second insulating layers 620 and 630 may be disposed on the third and fourth surfaces 103 and 104 of the body 100, respectively. The second insulating layers 620 and 630 may be formed on the third and fourth surfaces 103 and 104 of each body 100 after the dicing process described above. The second insulating layers 620 and 630 may be formed of an insulating film including an insulating resin, or may be formed of an insulating paste including an insulating resin. The second insulating layers 620 and 630 may include a photoimageable dielectric resin.

On the other hand, in forming the external electrodes 300 and 400 on the body 100 by plating, the second insulating layers 620 and 630 may be used as a plating resist together with the stress relieving portion 500 and the first insulating layer 610. Thus, the second insulating layers 620 and 630 may be formed on the first and second surfaces 101 and 102 of the body 100 as well as on the third and fourth surfaces 103 and 104 of the body 100. In this case, in regions of the second insulating layers 620 and 630, which are disposed on the first and second surfaces 101 and 102 of the body 100, respectively; openings may be formed to correspond to the connection portions 310 and 410 of the external electrodes 300 and 400, while exposing the coil portion 200 to the first and second surfaces 101 and 102 of the body 100.

The insulating film IF may be formed along the surfaces of the first coil pattern 211, the internal insulating layer IL, and the second coil pattern 212. The insulating film IF protects and insulates the respective coil patterns 211 and 212, and includes a known insulating material such as parylene. Any insulating material included in the insulating film IF may be used without particular limitations. The insulating film IF may be formed by vapor deposition or the like, but an embodiment thereof is not limited thereto. For example, the insulating film IF may be formed by forming an insulating material such as an insulating film on both surfaces of the internal insulating layer IL on which the first and second coil patterns 211 and 212 are formed. The above-described insulating film IF may be omitted in this embodiment depending on design requirements or the like.

Although not illustrated in the drawings, at least one of the first coil pattern 211 and the second coil pattern 212 may be formed of a plurality of layers. As an example, the coil portion 200 may have a structure in which a plurality of first coil patterns 211 are formed, in detail, one of the first coil patterns is laminated on another first coil pattern. In this case, an additional insulating layer may be disposed between the plurality of first coil patterns 211, and a connecting via may be formed in the additional insulating layer to penetrate therethrough, to connect the adjacent first coil patterns to each other.

As set forth above, according to an exemplary embodiment of the present disclosure, defects of coil components may be reduced during dicing.

In addition, a plating solution may be prevented from bleeding when external electrodes are formed.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body having a first surface and a second surface opposing each other, and including a plurality of wall surfaces respectively connecting the first surface and the second surface;

a coil portion embedded in the body;

first and second external electrodes spaced apart from each other, and respectively connected to the coil portion;

a groove extending continuously along all edges of the second surface of the body; and a stress relieving portion disposed on the second surface of the body and covering at least a portion of the groove.

2. The coil component of claim 1, wherein an area of the second surface of the body is smaller than an area of the first surface of the body.

3. The coil component of claim 1, wherein a side surface of the stress relieving portion and at least one of the plurality of wall surfaces of the body are disposed on substantially the same plane.

4. The coil component of claim 3, wherein with reference to a cross-section of the body in a thickness direction perpendicular to the first surface and the second surface of the body, an angle defined by a side surface of the stress relieving portion and one surface of the stress relieving portion, contacting the groove, is less than 90 degrees.

5. The coil component of claim 1, wherein the stress relieving portion comprises a resin.

6. The coil component of claim 5, wherein the stress relieving portion further comprises a filler dispersed in the resin.

7. The coil component of claim 6, wherein the filler may be an inorganic filler or an organic filler, and the inorganic filler is one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

8. The coil component of claim 1, further comprising an internal insulating layer embedded in the body, wherein the coil portion is disposed on at least one surface of the internal insulating layer.

9. The coil component of claim 1, further comprising a first insulating layer disposed on the first surface of the body, wherein the first and second external electrodes are spaced apart from each other on the first insulating layer.

10. The coil component of claim 9, wherein both ends of the coil portion are respectively exposed to both end surfaces of the body, opposing each other, among the plurality of wall faces of the body, and each of the first and second external electrodes comprises:

first and second connection portions respectively disposed on the both end surfaces of the body to be in contact with both ends of the coil portion; and first and second extensions respectively extending from the first and second connection portions to be spaced apart from each other on the first insulating layer.

11. The coil component of claim 10, further comprising, a second insulating layer disposed on the plurality of wall surfaces of the body, wherein the second insulating layer has an opening corresponding to each of the first and second connection portions.

12. The coil component of claim 1, wherein depths of the groove is 50 μm or more and 60 μm or less.

13. The coil component of claim 1, wherein the groove has an inwardly concave curvature.

14. A coil component comprising:

a body having a first surface and a second surface opposing each other, and including a plurality of wall surfaces respectively connecting the first surface and the second surface;

a coil portion embedded in the body;

first and second external electrodes spaced apart from each other, and respectively connected to the coil portion;

a groove disposed continuously along an edge of the second surface of the body; and a stress relieving portion disposed on the second surface of the body and covering at least a portion of the groove, wherein the stress relieving portion comprises a resin and a filler dispersed in the resin, the body comprises a magnetic metallic powder, and a particle diameter of the filler is less than a diameter of the magnetic metallic powder.

15. The coil component of claim 14, wherein the groove has an inwardly concave curvature.

16. A coil component comprising:

a body having a first surface and a second surface opposing each other, and including a plurality of wall surfaces respectively connecting the first surface and the second surface;

a coil portion embedded in the body;

first and second external electrodes spaced apart from each other, and respectively connected to the coil portion; and a stress relieving portion disposed on the second surface of the body, wherein the body has a groove extending continuously along all edges of the second surface of the body, whereby a dimension of the plurality of wall surfaces of the body in a thickness direction is smaller than a distance between the first surface and the second surface of the body.

17. The coil component of claim 16, wherein the stress relieving portion covers at least a portion of the groove, and has a side surface disposed on substantially the same plane as at least one of the plurality of wall surfaces of the body.

18. The coil component of claim 16, wherein the groove has an inwardly concave curvature.

* * * * *